United States Patent [19]

Beardmore

[11] Patent Number: 4,571,159

[45] Date of Patent: Feb. 18, 1986

[54] FUEL PUMP WITH INTEGRAL ACCUMULATOR

[75] Inventor: John M. Beardmore, Howell, Mich.

[73] Assignee: General Motors Corporation, Detroit, Mich.

[21] Appl. No.: 708,023

[22] Filed: Mar. 4, 1985

[51] Int. Cl.[4] ..... F04B 35/04; F04B 11/00

[52] U.S. Cl. ..... 417/366; 417/540

[58] Field of Search ..... 417/366, 423 R, 540, 417/542; 138/30; 310/57

[56] References Cited

U.S. PATENT DOCUMENTS

| | | | |
|---|---|---|---|
| 2,734,462 | 2/1956 | Schaefer | 417/540 |
| 4,181,473 | 1/1980 | Ira | 417/366 X |
| 4,521,164 | 6/1985 | Tuckey | 417/540 X |

FOREIGN PATENT DOCUMENTS

| | | | |
|---|---|---|---|
| 2929442 | 1/1981 | Fed. Rep. of Germany | 417/540 |
| 54-58931 | 11/1980 | Japan | 417/540 |
| 54-127938 | 5/1981 | Japan | 417/540 |

*Primary Examiner*—Carlton R. Croyle
*Assistant Examiner*—Theodore Olds
*Attorney, Agent, or Firm*—Donald F. Scherer

[57] ABSTRACT

A motor driven fuel pump assembly has an integral accumulator. The fuel pump is a two-stage pump with the secondary stage being a positive displacement unit such as a roller vane pump. The fluid output of the secondary pump is connected with a space surrounding the drive motor for the pump. The space is defined partially by a resilient membrane which is operable to expand with pressure increases and thereby absorb and damp the pressure and flow fluctuations from the secondary stage pump. The membrane member effectively provides a moving wall of an accumulator which serves to provide the damping effect on the flow and pressure variations within the system.

3 Claims, 1 Drawing Figure

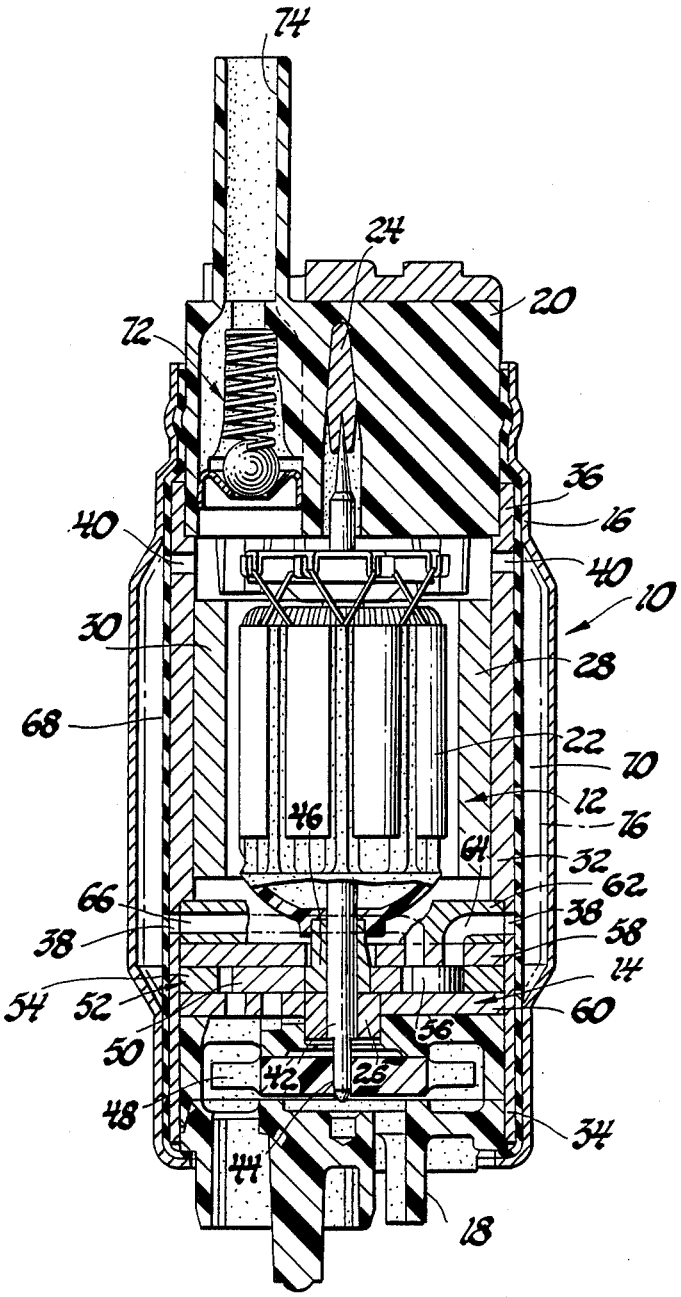
74
24
20
72
36
16
40
40
10
30
28
68
22
70
12
76
46
64
32
62
66
38
38
58
14
54
52
60
56
50
42
26
48
34
44
18

FUEL PUMP WITH INTEGRAL ACCUMULATOR

BACKGROUND OF THE INVENTION

This invention relates to fuel systems and more particularly to fuel systems which include an accumulator.

Prior art fuel systems have provided accumulators connected to the flow passage between the fuel pump discharge and the fuel feed mechanism, such as an injector, for an internal combustion engine. While such systems are effective, they do require the addition of an accumulator assembly and the necessary piping or tubing to connect the accumulator to the system. These systems also provide a point of fuel leakage within the system.

SUMMARY OF THE INVENTION

The present invention incorporates an electric motor driven fuel pump accumulator directly within the housing of the motor driven fuel pump in a space surrounding the flux carrier which drives the fuel pump. The accumulator disposed in this space requires that the external housing surface of the motor driven fuel pump has a slightly larger diameter than the same motor driven fuel pump without the accumulator.

It is therefore an object of this invention to provide an improved fuel pump and accumulator wherein the fuel pump includes a motor and a pump with the motor having a substantially cylindrical flux carrier and also wherein a resilient membrane member is disposed surrounding the flux carrier and further wherein the fluid discharge from the pump is directed to the space between the membrane and the flux carrier whereby an accumulator action is provided.

It is another object of this invention to provide an improved motor driven fuel pump with the motor including a cylindrical flux carrier disposed within a shell member housing the pump and motor and also wherein a resilient membrane member is disposed between the flux carrier and the shell member in fluid communication with the discharge fluid of the pump prior to the point of discharge of the fluid from the pump motor assembly.

It is a further object of this invention to provide an improved motor driven fuel pump wherein a resilient membrane member is disposed in a space surrounding at least the motor portion of the fuel pump and wherein the space cooperates with the resilient membrane member to provide an accumulator which is effective to reduce pressure and flow pulsations present at the pump discharge prior to discharge of the fluid from the fuel pump assembly.

DESCRIPTION OF THE DRAWING

The drawing represents a cross sectional elevational view of a motor driven fuel pump incorporating the invention.

DESCRIPTION OF THE PREFERRED EMBODIMENT

There is seen in the drawing, a motor driven fuel pump, generally designated 10, including an electric motor assembly 12, a pump assembly 14, a shell or housing 16, an inlet end cap 18 and a discharge end cap 20. The motor assembly 12 includes an armature 22 rotatably supported in a bearing 24 disposed in the end cap 20, and a bearing 26 disposed in the pump assembly 14. The motor assembly 12 further includes a pair of magnets 28 and 30 disposed about the periphery of armature 22 and maintained magnetically and mechanically fixed in abutment with the inner surface of a cylindrical flux carrier 32. The flux carrier 32 has annular longitudinal extensions 34 and 36 which provides support respectively for the end caps 18 and 20. The flux carrier 32 has formed therein a plurality of radial passages 38 and another plurality of radial passages 40.

A motor shaft 42 is rotatably supported in the bearing 26 and has formed thereon a pair of drive surfaces 44 and 46 which are operative to drive a centrifugal pump rotor 48 and a roller vane pump rotor 50, respectively. The centrifugal pump rotor 48 provides a first or primary stage pumping action for the pump 14. The output or discharge flow of the centrifugal pump rotor is connected with the inlet of a roller vane pump, generally designated 52. The rotor 50 is a component of the roller vane pump 52 which also includes a cam ring 54, a plurality of roller vanes 56 and a pair of side plates 58 and 60. The roller vane pump 52 is the secondary or high pressure stage of the pump assembly 14. Both of the pump stages, the centrifugal stage and the roller vane stage are conventional pump assemblies, the construction of which is well-known in the fuel pump art.

A housing 62 is disposed adjacent the side plate 58 and has formed therein a pair of fluid passages 64 and 66 which are in fluid communication with the discharge of the roller vane pump 52. As is well-known, pumps, such as roller vane pumps, effectively provide two pumping actions. One of the pumping actions is provided by the space between adjacent rollers and the other is provided by the space between the radially inner surface of the roller vane and the slot in the rotor in which the roller vane is contained. The pump discharge from between the rotors is connected to a passage 64 while the pump discharge beneath the rollers is connected to passage 66. The passages 64 and 66 are connected with respective ones of the radial passages 38.

A cylindrical resilient member or membrane 68 is disposed adjacent the outer cylindrical surface of the flux carrier 32 and is maintained in this position by crimping the shell or housing 16 at the ends thereof. The crimping is sufficient to provide a fluid tight seal at both ends of the shell and the flux carrier. The shell 16 is further deformed at both ends to secure the end caps 18 and 20 to the remainder of the fuel pump assembly 10. The radial passages 38 and radial passages 40 are in communication with the space or interface between the resilient membrane 68 and the flux carrier 32.

As seen in the drawing, an annular air space 70 is provided between the outer surface of membrane 68 and the inner surface of shell 16 for substantially the axial length of the motor assembly including the axial positions of the radial passages 38 and 40. The radial passages 40 are open for fluid communication, at the radial inner ends thereof, with the discharge end cap 20. The discharge end cap 20 has disposed therein a conventional ball check valve, generally designated 72, which is operable to permit fluid flow from radial passages 40 to a fuel discharge tube 74 but preventing fuel flow in the opposite direction.

In the position shown, the fuel pump 10 is inactive. When the fuel pump 10 is placed in a fuel system and the electric motor assembly 12 is operated, the pump assembly 14 will discharge fluid through the passages 38 to the space between the resilient membrane 68 and the flux carrier 32. The pressure in the fuel from the pump assembly 14 will cause the membrane 68 to move radially outward from the position shown toward the phantom line position 76. The membrane 68, under most conditions of operation, will not reach the extremes shown by the phantom line position 76. The extent of the radial expansion of the membrane 68 will depend upon the pressure in the fuel as it is discharged from the pump assembly 14.

As is well-known, positive displacement pumping assemblies, such as a roller vane pump, produce pressure fluctuations in the discharge flow. These pressure fluctuations will be absorbed and damped by the resilient membrane 68 prior to the fluid passing radially inward through the passages 40 and out of the fuel pump discharge tube 74. Therefore, the fuel being discharged from the fuel pump 10 will have a constant pressure with the pressure pulsations substantially reduced or nonexistent.

It will be recognized from the foregoing description that the resilient membrane member 68 cooperates with the flux carrier 32 and the space 70 to provide an effective accumulator disposed completely within the housing of the electric motor driven pump assembly 10. The pump discharge, in the preferred embodiment, is shown as passing through the accumulator formed in part by the membrane 68 prior to exiting the pump assembly.

It is also possible to provide a fluid passage from the roller vane pump 52 to the space surrounding the armature 22 and from this space to the pump discharge 74. With this type of an arrangement, the pressure and flow pulsations would still be effective through passages 38 and 40 to react on the flexible membrane 68 such that the accumulator action would be present without the full discharge flow through the accumulator. However, it is believed that the full flow accumulator structure as shown provides more efficient damping of flow and pressure variations which are inherent at the discharge of a positive displacement pump.

The use of an accumulator connected in parallel, however, reduces the number of components necessary in a pump assembly and therefore provides an economical structure. With a parallel accumulator structure, the housing 62 is eliminated and, if desired, the entire pump motor structure can be shortened.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A fuel pump comprising: a pump portion; a motor means for driving said pump portion; said motor means including a flux carrier; a resilient membrane member surrounding said flux carrier; a shell member surrounding said resilient membrane member and including a portion radially spaced from said resilient membrane member; said pump portion having discharge means in fluid communication with said resilient membrane member between said resilient membrane member and said flux carrier for discharging high pressure fluid thereto, said resilient membrane member being responsive to the pump discharge fluid pressure to expand into the space provided by said portion radially spaced from said resilient membrane member in response to high pressure fluid to thereby provide an accumulator for the pressure discharge of said pump portion.

2. A fuel pump comprising: a pump portion; a motor means for driving said pump portion; said motor means including a flux carrier; a resilient membrane member surrounding said flux carrier; a shell member surrounding said resilient membrane member and including a portion radially spaced from said resilient membrane member; said pump portion having discharge means in direct fluid communication with said resilient membrane member between said resilient membrane member and said flux carrier for discharging high pressure fluid thereto, said resilient membrane member being responsive to the pump discharge fluid pressure to expand into the space provided by said portion radially spaced from said resilient membrane member in response to high pressure fluid to thereby provide an accumulator for the pressure discharge of said pump portion, said fluid discharged between said resilient member and said flux carrier being directed therefrom at a location spaced from the discharge means of said pump portion.

3. A fuel pump comprising: a pump portion; a motor means for driving said pump portion; fuel discharge means; said motor means including a flux carrier; a resilient membrane member surrounding said flux carrier and providing an accumulator space therebetween; a shell member surrounding said resilient membrane member and including a portion radially spaced from said resilient membrane member; said pump portion having discharge means; first passage means communicating with said accumulator space directly from said pump discharge means for discharging high pressure fluid to said accumulator space, said resilient membrane member being responsive to the pump discharge fluid pressure to expand into the space provided by said portion radially spaced from said resilient membrane member in response to high pressure fluid to thereby provide an accumulator for the pressure discharge of said pump portion; and second passage means for communicating fluid from said accumulator space to said fuel discharge means at a location axially remote from said first passage means.

* * * * *